US006039198A

United States Patent [19]

Wolfe et al.

[11] Patent Number: 6,039,198

[45] Date of Patent: Mar. 21, 2000

[54] PIERCE AND CUT CLOSURE

[75] Inventors: Steven R. Wolfe, Maumee; James G. Mierzwiak, Toledo, both of Ohio

[73] Assignee: Owens-Illinois Closure Inc., Toledo, Ohio

[21] Appl. No.: 09/198,253

[22] Filed: Nov. 24, 1998

[51] Int. Cl.[7] ..... B65D 17/44

[52] U.S. Cl. ..... 215/228; 215/257; 220/278

[58] Field of Search ..... 215/226, 228, 215/232, 250, 257, 295, 302, 303, 48; 220/212, 258, 265, 267, 277, 278

[56] References Cited

U.S. PATENT DOCUMENTS

| | | | |
|---|---|---|---|
| 4,634,013 | 1/1987 | Bar-Kokhba . | |
| 5,090,582 | 2/1992 | Art et al. . | |
| 5,505,326 | 4/1996 | Janko . | |
| 5,709,311 | 1/1998 | Butler et al. . | |
| 5,797,506 | 8/1998 | Lehmkuhl et al. | 220/278 X |

FOREIGN PATENT DOCUMENTS

| | | | |
|---|---|---|---|
| 2153446 | 5/1973 | Germany | 215/257 |

*Primary Examiner*—Nathan Newhouse

[57] ABSTRACT

A cut and pierce closure molded from a rigid plastic material for a container whose open mouth is normally sealed by a thin membrane applied to a rim of the container. The closure is removably applied to the container in a closing orientation by interengaging helical threads on the exterior of a neck of the container and an annular skirt of the closure. To dispense the contents of the container, the closure is removed and reapplied in an inverted orientation, a flange extension of the closure skirt surrounding the rim of the container and serving to center the closure in its inverted orientation on the container. A top panel of the closure is provided with a double-ended arcuate shoulder that engages the membrane when the closure is in its inverted orientation on the container to maintain tension in the portion of the membrane in engagement with the shoulder. The arcuate shoulder also serves, in combination with the flange extension, to trap the rim of the container therebetween. A sharp cutting element projects axially from the shoulder at a location between its ends and functions to pierce the membrane when the closure is reapplied, in its inverted orientation, to the container. When the closure is rotated on the container in the inverted orientation, the cutting element will cut the membrane along an arc of less than 360° even if the closure is rotated 360° or more, to thereby permit dispensing of the contents of the container after removal of the closure from the container while ensuring that the severed membrane remains affixed to the rim of the container without dropping into the contents of the container.

9 Claims, 2 Drawing Sheets

PIERCE AND CUT CLOSURE

FIELD OF THE INVENTION

This invention relates to a closure for application to a bottle or other container whose mouth is normally closed and sealed by a thin membrane of a metallic foil or the like, the closure being removably applied to the container after the membrane is applied thereto. More particularly, this invention relates to a closure of the foregoing character that is provided with a cutting element which, when the closure is removed from its closing position on the container and reapplied to the container in an inverted orientation, will pierce the membrane that seals the mouth of the container to permit dispensing of the contents of the container.

BACKGROUND OF THE INVENTION

Many products are packaged in bottles or other containers whose mouths are sealed by a thin membrane of a suitable material, such as a metallic foil or a plastic film, until a consumer or other user is ready to remove the contents of the container for consumption or use after piercing of the sealing membrane. Various types of infant formula are packaged in this manner. In addition to the membrane that seals the mouth of such a container, it is also customary to apply a removable molded plastic closure to the container to protect the membrane from damage during shipment and storage of the filled container and to re-close the container after partial removal of its contents, the membrane no longer serving to seal the container at this time due to its piercing. Typically, in such a packaging application the piercing of the membrane is accomplished by one or more piercing elements on the top of the closure after removing the closure and reapplying it to the container in an inverted orientation. U.S. Pat. No. 5,709,311 (Butler et al.), U.S. Pat. No. 5,505,326 (Junko), and U.S. Pat. No. 5,090,582 (Art et al.) describe closures of this general type.

Piercing closures of the type described are also used to cut the membrane through an arc of substantial extent, often 360°, by turning the closure on the container, after inverting the closure on the container. Unfortunately, the quality of this cutting action often degrades as the length of the cut increases, due to a loss in the tension in the membrane as the cutting action proceeds. This problem makes it difficult to properly remove the contents of the container, with resultant aggravation of the user or consumer and loss of good will of the manufacturer whose product is packaged in the container. Further, it is quite desirable that the cutting of the membrane which seals the mouth of the container not extend over an arc of 360°, so that the severed membrane will remain attached to the container and not drop into its contents

BRIEF DESCRIPTION OF THE INVENTION

According to the present invention there is provided an improved closure of the cut and pierce type for a membrane-sealed container. The closure of this invention has, on its upper surface in the normal orientation of the closure on the container, an upwardly projecting flange, which is positioned to closely surround the mouth of the associated container when the closure is reapplied to the container in an inverted orientation, an arcuate shoulder, which is positioned radially inwardly of the flange to be closely positioned to the interior of the mouth of the container, and a piercing and cutting element that projects upwardly from the shoulder and extends over a somewhat smaller arc. To gain access to the contents of the container through the membrane, the closure is removed from the container, for example, by unscrewing it, and is then reapplied to the container in an inverted orientation with the rim of the container that surrounds its mouth being trapped between the flange surrounding the upper surface of the container and the arcuate shoulder. This will cause the piercing and cutting element to pierce the membrane and will cause the arcuate shoulder to snuggly engage the portion of the membrane therebelow to put tension therein. Rotation of the closure on the container, while the closure is in its inverted orientation, will cause the cutting and piercing element to cut the membrane along an arc that is concentric with and close to the interior of the container mouth. During this cutting action, the shoulder in the top of the closure maintains suitable tension for cutting in the membrane for most of an arc of 360°, notwithstanding gradual loss in tension in the membrane as the cutting action proceeds. However, near the end of the cutting arc, the tension in the membrane is so low, notwithstanding engagement by the shoulder at the top of the closure, that no further cutting action occurs. Thus, the membrane never totally detaches from the container mouth even if the closure is rotated by more than 360° while in its inverted orientation on the container, and the shoulder of the closure will simply ensure that the membrane is securely folded against the interior of the container for the final, minor portion of the double-ended arc along which it is cut.

Accordingly, it is an object of the present invention to provide an improved closure of the piercing and cutting type for a container with a membrane-sealed mouth. It is a further object of the present invention to provide a closure of the aforesaid type in which the cutting action of the membrane by the closure proceeds smoothly over an arc of somewhat less than 360° by an action in which the closure is turned at least 360° on the container during the cutting action. It is also an object of the present invention to provide a package that is made up of a container with a membrane-sealed mouth that is normally closed by a removable closure of the aforesaid type.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
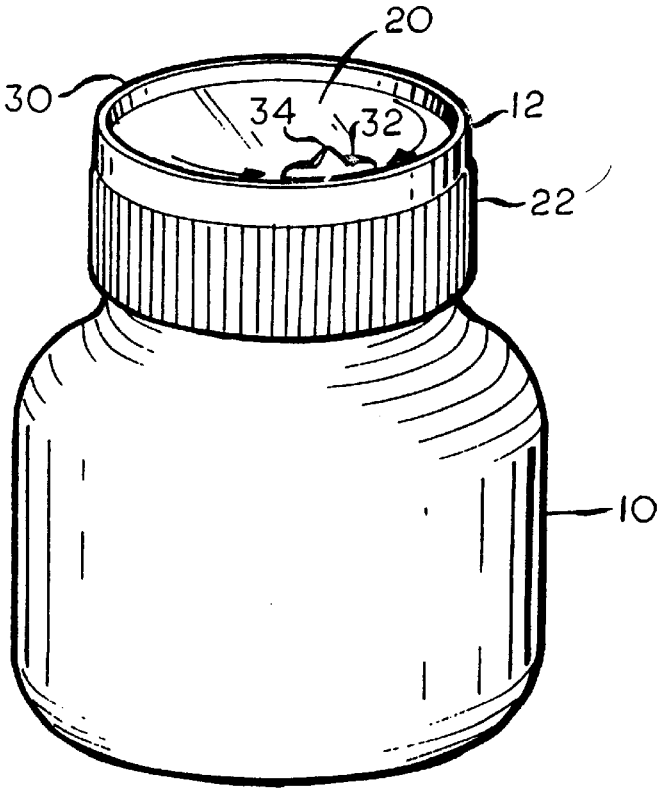
FIG. 1 is a perspective view of a container with a closure according to a preferred embodiment of the present invention removably applied thereto.

FIG. 1 illustrates a container 10, which may be considered to be a molded plastic bottle or any other type of container that may be removeably closed by a separate closure, with a closure 12 removeably applied to a neck portion 14 (FIG.

3) of the container 10, for example, by a threaded connection between an internal helical thread 16 of the closure 12 and an external helical thread 18 on the neck 14 of the container 10. The closure 12, in its normal orientation on the container 10, has a top panel 20 and an annular skirt 22 that depends from the periphery of the top panel 20, the helical thread 16 projecting inwardly from the annular skirt 22 to engage the external helical thread 18 of the container 10.

Figure 3:
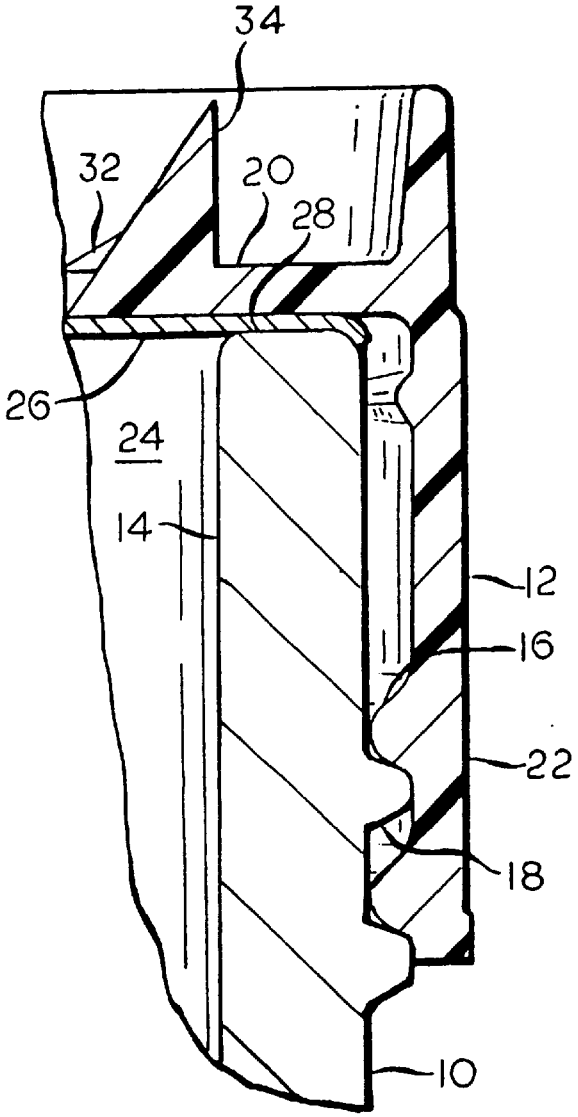
FIG. 3 is a fragmentary cross-sectional view, at an enlarged scale, of the container and closure shown in FIG. 1 in the normal closing orientation of the closure on the container.

As is shown in FIG. 3, an open mouth portion 24 of the container 10, which is the portion surrounded by the neck portion 14, is sealed after the filling of the container 10 by a thin membrane 26, such as a foil film, which is sealingly applied in a circumferential pattern to a rim 28 at a free end of the neck portion 14 of the container 10. In the closing position of the closure 12 on the container 10, as shown in FIG. 3, the underside of the top panel 20 on the closure 12 seats against the top of the membrane 26.

Figure 2:
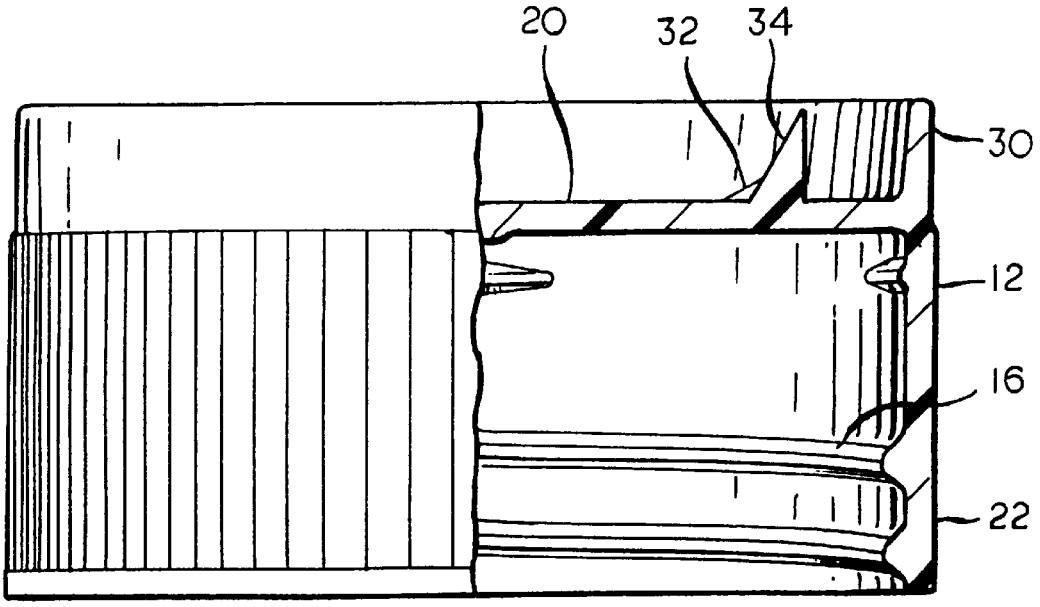
FIG. 2 is an elevation view, partly in cross-section and at an enlarged scale, of the closure shown in FIG. 1.
Figure 4:
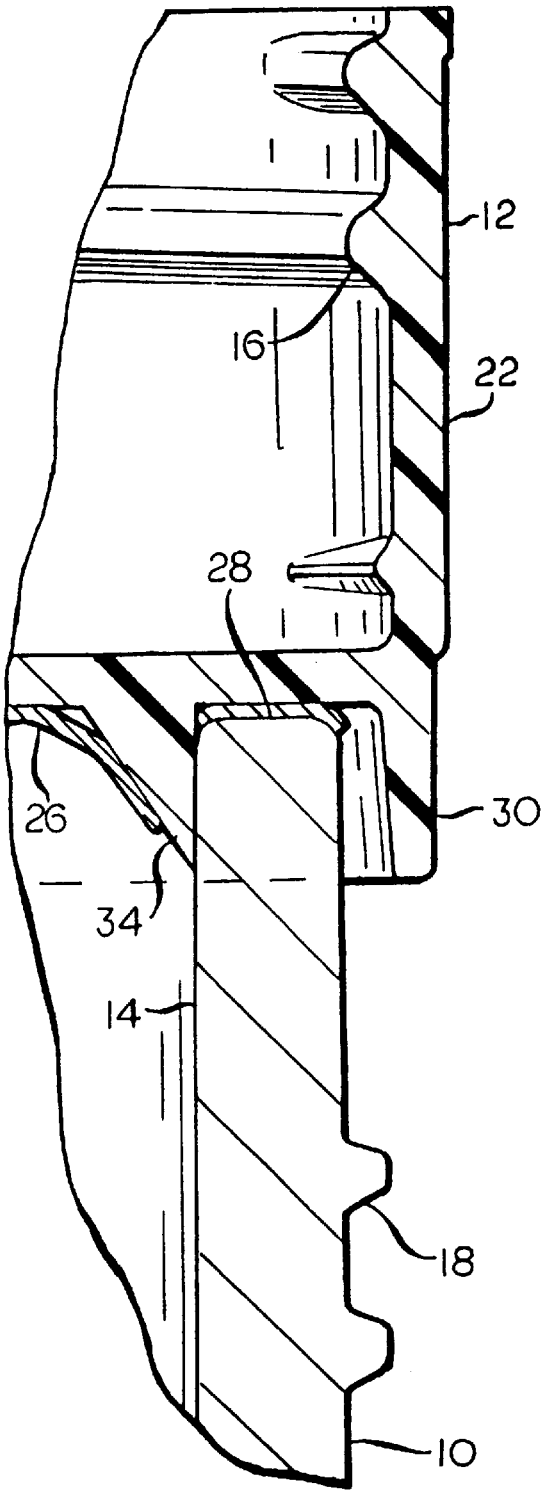
FIG. 4 is a view like FIG. 3 but with the closure applied in an inverted orientation on the container to demonstrate the piercing action of a membrane sealing the mouth of the container by the closure in such orientation.

The closure 12 also has, extending upwardly from the top panel 20 in the orientation shown in FIGS. 1–3, a perimetrical flange 30, which is generally axially aligned with the annular skirt 22 of the closure 12 and may be considered to be an extension thereof. The flange 30 is positioned to closely surround the rim 28 of the neck portion 14 of the container 10 when the closure 12 is removed from the container 10 and reapplied in an inverted orientation, as shown in FIG. 4. The closure 12 also has an arcuate shoulder 32 extending upwardly from the top panel 20 of the closure 12, at a location radially inwardly of the flange 30, and the rim 28 of the neck portion 14 of the container 10 is trapped between the arcuate shoulder 32 and the flange 30 when the closure 12 is reapplied to the container 10 in the inverted orientation of the closure 12.

The closure 12 is also provided with a sharp cutting element 34 that projects upwardly from a central portion of the arcuate shoulder 32, but over a much smaller arc. The cutting element 34 pierces the membrane 26 when the closure 12 is reapplied to the container 10 in the inverted orientation of the closure 12, as shown in FIG. 4. From the position of the closure on the container 10 that is shown in FIG. 4, the closure 12 is then rotated on the container 10, preferably over an arc of at least 360°. This will cause the cutting element 34 to cut the membrane 26 in an arcuate pattern, the membrane 26 being held in tension by contact with the arcuate shoulder 32 through almost all of an arc of 360°, notwithstanding a loss in tension in the membrane 26 as the cutting action proceeds. However, near the end of a 360° cut in the membrane 26, the tension in the membrane 26 will be so relaxed that no further cutting of the membrane 26 will occur notwithstanding the presence of the arcuate shoulder 32 and any further rotation of the closure 12 on the container 10 in the inverted orientation of the closure 12.

The closure 12 is preferably formed in its illustrated, complex configuration integrally in a single piece from a suitable rigid thermoplastic material, such as polypropylene, by a suitable molding process, for example, by injection molding.

Although the best mode contemplated by the inventors for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A closure for application to a mouth of a container, the container being sealed by a thin, sevearable membrane applied to a rim at the mouth of the container and having closure engaging means projecting outwardly from a neck portion of the container at a location below the rim for permitting the closure to be removeably attached to the container, the closure comprising:

an annular skirt having first and second annular ends;

a planar top panel member within said annular skirt and extending perpendicularly with respect to said annular skirt;

container engaging means projecting inwardly from said annular skirt at a location between said first annular end and said top panel member for engaging the closure engaging means of the container; and thin film severing means projecting perpendicularly from said top panel member toward said second annular end of said annular skirt, said thin film severing means being spaced inwardly from said annular skirt and comprising;

an arcuate shoulder having an arcuate extent of less than 360° for engaging the thin, severable membrane on the container when the closure is applied to the container with the film severing means facing toward an interior of the container, said arcuate shoulder being adapted to tighten a portion of the thin, severable membrane in engagement therewith, and a sharp cutting element projecting axially outwardly from said arcuate shoulder at a location between opposed ends of said arcuate shoulder;

said closure being freely rotatable with respect to the mouth of the container when said closure is applied to the mouth of the container with said thin film severing means facing toward the interior of the container with the rim of the container centered between said arcuate shoulder and said annular skirt to permit the sharp cutting element to pierce and cut the thin, severable membrane when said closure is rotated with respect to the mouth of the container.

2. A closure according to claim 1 wherein the container engaging means of said closure is a helical thread.

3. A closure according to claim 1 wherein said closure is manufactured in a single piece from a rigid thermoplastic material by molding.

4. A closure according to claim 3 wherein said rigid thermoplastic material is comprised mainly of polypropylene.

5. A package comprising, in combination:

a container having a rim defining a mouth at an open end and having closure engaging means projecting outwardly from a neck portion circumscribing said mouth for permitting a closure to be removably attached to said container;

a thin, severable membrane sealingly applied to said rim of said container; and a closure removably applied to said container, said closure comprising;

an annular skirt having first and second annular ends, a planar top panel within said annular skirt and extending perpendicularly with respect to said annular skirt, container engaging means projecting inwardly from said annular skirt at a location between said first annular end and said planar top panel member and removeably engaging said closure engaging means of said container, and membrane severing means projecting perpendicularly from said planar top panel member toward said second annular end, said film severing means being spaced radially inwardly from said annular skirt portion and comprising, an arcuate shoulder having an arcuate extent of less than 360° for engaging the thin, severable membrane on said container when said closure is applied to said container with said film severing means facing toward an interior of said container, said arcuate shoulder being adapted to tighten a portion of the thin, severable membrane in engagement therewith, and a sharp cutting element projecting axially outwardly from said arcuate shoulder at a location between opposed ends of said arcuate shoulder;

said closure being freely rotatable with respect to said mouth of said container when said closure is applied to said mouth of said container with said film severing means facing toward the interior of said container with the rim of said container centered between said arcuate shoulder and said annular skirt to permit said sharp cutting element to pierce and cut said thin, severable membrane when said closure is rotated with respect to said mouth of said container.

6. A package according to claim 5 wherein said closure engaging means of said container comprises a helical thread, and wherein said container engaging means of said closure comprises a helical thread.

7. A package according to claim 5 wherein said thin, severable membrane comprises a metallic foil.

8. A package according to claim 6 wherein said closure is manufactured in a single piece from a rigid thermoplastic material by molding.

9. A package according to claim 8 wherein said rigid thermoplastic material is comprised mainly of polypropylene.

* * * * *